United States Patent [19]

Rozzi

[11] Patent Number: 4,951,437

[45] Date of Patent: Aug. 28, 1990

[54] CURVED WALLS FROM FLAT PREFABRICATED PANEL FORMED FROM THREE-DIAMENSIONAL METAL SCREEN WITH FORMED PLASTIC FILLING

[75] Inventor: Costantino Rozzi, Ascoli Piceno, Italy

[73] Assignee: R.E.In. S.p.A., Italy

[21] Appl. No.: 295,236

[22] Filed: Jan. 9, 1989

Related U.S. Application Data

[62] Division of Ser. No. 62,477, Jun. 12, 1987, Pat. No. 4,831,699.

[30] Foreign Application Priority Data

Jun. 16, 1986 [IT] Italy ..... 20795 A/86

[51] Int. Cl.[5] ..... E04G 11/04

[52] U.S. Cl. ..... 52/249; 52/309.12; 52/631

[58] Field of Search ..... 52/249, 309.12, 405, 52/410, 648, 80, 88, 108, 631; 428/136, 137, 155, 167, 256; 29/155 R, 445, 458, 460

[56] References Cited

U.S. PATENT DOCUMENTS

| | | | |
|---|---|---|---|
| 3,404,500 | 10/1968 | Akita et al. | 52/249 |
| 3,440,790 | 4/1969 | Nerem | 52/631 |
| 3,562,973 | 2/1971 | Gangemi | 52/631 |
| 3,879,908 | 4/1975 | Weismann | 52/410 X |
| 3,989,329 | 11/1976 | Benford | 52/631 |
| 4,024,684 | 5/1977 | Holmgren | 52/631 |
| 4,284,447 | 8/1981 | Dickens et al. | 52/309.12 X |
| 4,505,019 | 3/1985 | Deinzer | 52/309.12 X |
| 4,614,013 | 9/1986 | Stevenson | 29/155 |
| 4,671,035 | 6/1987 | Ridge | 52/631 |
| 4,785,602 | 11/1988 | Giurlani | 52/405 X |
| 4,831,699 | 5/1989 | Rozzi | 29/445 X |

*Primary Examiner*—David A. Scherbel
*Assistant Examiner*—Creighton Smith
*Attorney, Agent, or Firm*—Eckert Seamans Cherin & Mellott

[57] ABSTRACT

A flat prefabricated panel formed from a three-dimensional metal screen and from a reference layer of foamed plastic is converted into a curved panel suitable for the formation of a curved wall by cutting said screen along parallel lines on one face of the panel, utilizing said cut line to incurvate the panel to make the opposite face thereof concave and finally restoring the integrity of the screen on said face of the panel by means of reticular connecting strips applied along said cutting lines.

5 Claims, 2 Drawing Sheets

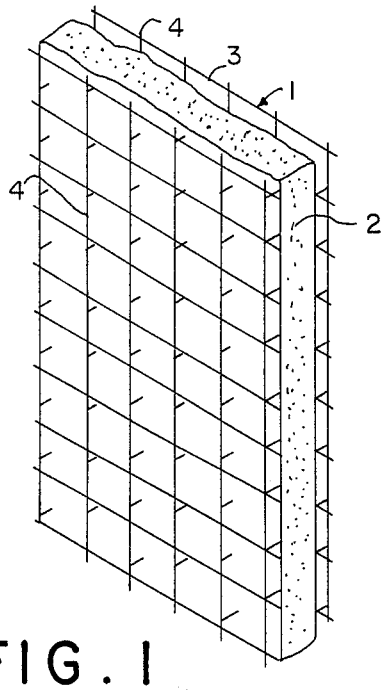
FIG. 1
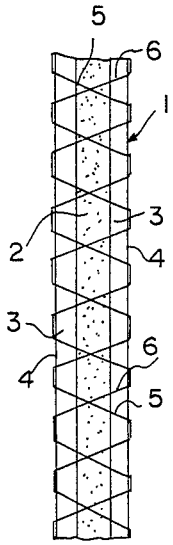
FIG. 2
FIG. 5
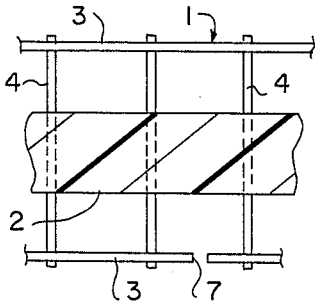
FIG. 7
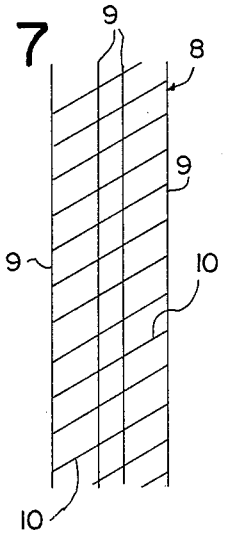

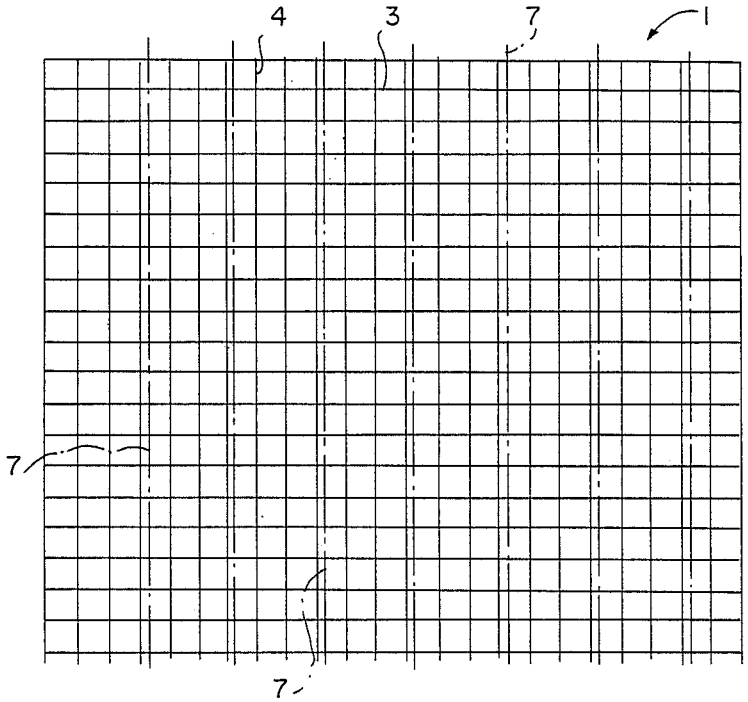
FIG. 3
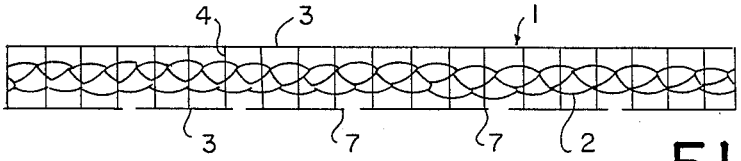
FIG. 4
FIG. 6
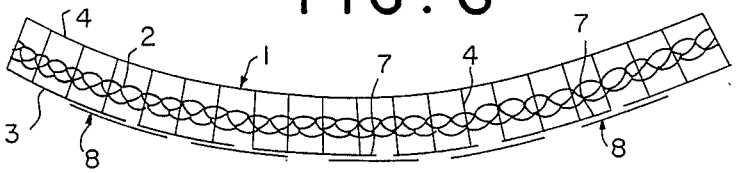

CURVED WALLS FROM FLAT PREFABRICATED PANEL FORMED FROM THREE-DIAMENSIONAL METAL SCREEN WITH FORMED PLASTIC FILLING

CROSS REFERENCE TO RELATED APPLICATION

This is a division of U.S. patent application Ser. No. 062,477, filed June 12, 1987, now U.S. Pat. No. 4,831,699.

DESCRIPTION

The present invention relates to a process for making curved walls starting with a flat prefabricated panel formed from three-dimensional metal screen with foamed plastic filling.

Prefabricated building panels comprising a three-dimensional metal screen partially filled with an interior layer of foamed plastic material are known.

Due to the effect of the abovesaid structure said panels are essentially flat and, at least in appearance, do not lend themselves to making a curved wall.

The object of the present invention is to provide a process for making curved walls starting with a flat panel of the abovesaid type.

In accordance with the invention said object is achieved by a process characterized in that it comprises cuts in parallel lines of said screen on one face of the panel, curving the panel utilizing said cutting lines to make the opposite face of the panel concave, then restoration of the integrity of the screen on said face of the panel by means of reticular connecting strips applied along said cut lines.

In a very simple and rapid manner an essentially flat panel is thus converted into a curved panel suitable for making curved walls.

For better understanding of the invention reference will be made to the annexed drawings wherein:

FIG. 1 shows a perspective view of a piece of flat prefabricated panel which the process in accordance with the invention converts into a curved panel, FIG. 2 shows a cross section of said panel along the line II—II of FIG. 1, FIG. 3 shows the front elevation of the panel of FIGS. 1 and 2 with one face thereof cut along vertical parallel lines, FIG. 4 shows a top view of the panel in the same condition, FIG. 5 shows an enlarged view of a detail of the panel of FIG. 4, FIG. 6 shows the curved panel with the integrity of the convex face restored by application of reticular connecting strips, and FIG. 7 shows the front elevation of said connecting strips.

FIGS. 1 and 2 show a flat prefabricated building panel consisting of a three-dimensional metal screen partially filled with a flat layer 2 of foamed plastic such as, for example, polyurethane foam.

The three-dimensional screen 1 is in reality formed from two parallel flat nets with perpendicular rows 3 and 4 joined together by cross-pieces 5 and 6 alternately inclined first in one direction and then in the opposite direction as may be seen in FIG. 2.

The structure of this screen and in general of the entire panel is known in itself and will therefore not be explained further.

To convert the flat panel shown in FIGS. 1 and 2 into a curved panel suitable for making curved walls the horizontal wires of one of the two parallel nets are cut along parallel vertical lines shown schematically and indicated with reference number 7 in the front elevation of FIG. 3. The same reference number indicates in the top view of FIGS. 4 and 5 the cuts made in said horizontal wires 3.

It thus becomes possible to bend the panel in such a manner as to make the face having the cuts 7 convex and the opposite face concave. This is clearly allowed by the cuts made in the flat net in combination with the deformability of the uncut flat net and the filling layer 2.

In this manner there is obtained the curved panel shown in FIG. 6, the integrity of the face of which is restored by using over each cut line 7 a reticular connecting strip 8 of the type shown in FIG. 7, i.e. formed of vertical wires 9 connected by oblique cross-pieces 10. As shown in FIGS. 3 and 7, the curved net defined in part by wires 3 is cut along cut lines 7, the cuts extending along parallel lines coinciding with generatrices (i.e., contour lines) of the curved concave face. Reticular connecting strips 8 bridge the cuts and restore the integrity of the cut net.

The strips 8 are appropriately connected, e.g. by welding, to the perpendicular wires 3 and 4 of the cut net to obtain the finished curved panel shown in FIG. 6.

I claim:

1. A curved-wall panel comprising a three-dimensional grid of metal wires having one face formed by a concave net of metal wire, an opposite face formed by a convex metal wire net and an oblique cross-piece of metal are connecting said nets, said convex net being provided with gaps along lines parallel to an axis of curvature of said convex net and with net-like flat connecting strips attached over said gaps.

2. Panel in accordance with claim 1 characterized in that said metal screen is partially filled with a curved layer of foamed plastic.

3. Panel in accordance with claim 1 characterized in that said reticular connecting strips consist of parallel metal wires connected by oblique cross-pieces.

4. A panel for curved walls, comprising:

three-dimensional metal screen having cuts in parallel lines on one face of the screen, the screen being curved such that a face of the panel opposite from the cuts is concave;

a plurality of reticular connecting strips attached to the screen at the cuts, the strips restoring integrity of the screen; and, foamed plastic filling in the screen.

5. A panel for curved walls comprising:

a metal screen formed from a first curved net on a concave face of the panel;

a second curved net parallel to the first curved net and connected thereto by oblique cross-pieces, the second curved net being provided with cuts along parallel lines coinciding with generatrices of the concave faces; and, reticular connecting strips applied along said cuts, restoring integrity of said second net.

* * * * *